US008474616B2

(12) United States Patent
Farid et al.

(10) Patent No.: US 8,474,616 B2
(45) Date of Patent: Jul. 2, 2013

(54) SUPPORT FOR FOOD PRODUCT ARRANGEMENT AND METHOD FOR ASSEMBLING AN ARRANGEMENT

(76) Inventors: Tariq Farid, North Haven, CT (US); Kamran Farid, Cheshire, CT (US); Amit Doshi, North Wales, PA (US)

( * ) Notice: Subject to any disclaimer, the term of this patent is extended or adjusted under 35 U.S.C. 154(b) by 69 days.

(21) Appl. No.: 12/362,510

(22) Filed: Jan. 30, 2009

(65) Prior Publication Data

US 2009/0223849 A1 Sep. 10, 2009

Related U.S. Application Data

(60) Provisional application No. 61/034,536, filed on Mar. 7, 2008.

(51) Int. Cl.
*B65D 85/50* (2006.01)

(52) U.S. Cl.
USPC ..... 206/423; 206/457; 206/523

(58) Field of Classification Search
USPC ..... 206/423, 457, 523, 524, 591, 592, 206/6.1, 521; 248/27.8
See application file for complete search history.

(56) References Cited

U.S. PATENT DOCUMENTS

| | | | | |
|---|---|---|---|---|
| 4,606,950 | A * | 8/1986 | Corbet | 428/23 |
| 4,899,888 | A * | 2/1990 | Shawler | 206/586 |
| 5,149,721 | A * | 9/1992 | Ishikawa et al. | 521/79 |
| 5,213,215 | A * | 5/1993 | Prevot | 206/588 |
| 5,229,149 | A * | 7/1993 | Cone | 426/91 |
| 5,628,402 | A * | 5/1997 | Dickie et al. | 206/521 |
| 5,645,168 | A * | 7/1997 | Honkawa | 206/423 |
| 6,706,379 | B2 * | 3/2004 | Weder | 428/221 |
| 7,310,910 | B2 * | 12/2007 | Miller et al. | 47/41.12 |
| 2002/0068262 | A1 | 6/2002 | Robinson | |
| 2002/0195366 | A1 | 12/2002 | Castleberry | |
| 2008/0099356 | A1 * | 5/2008 | Keller et al. | 206/423 |

* cited by examiner

*Primary Examiner* — J. Gregory Pickett
*Assistant Examiner* — Robert Poon

(57) ABSTRACT

A support for a food product display arrangement is presented. The support includes a cylindrical structure having a diameter, an exterior surface and a height. The cylindrical structure is a food safe, foam material having a density suitable for supporting at least one of food products and display elements. The cylindrical structure is selectively adjustable about its diameter and height to accommodate a container used in the display arrangement. A plurality of supports are disposed in the cylindrical structure at positions and angles to create a visually interesting and aesthetically pleasing food product display arrangement. A plurality of food items are coupled to the supports.

2 Claims, 8 Drawing Sheets

SUPPORT FOR FOOD PRODUCT ARRANGEMENT AND METHOD FOR ASSEMBLING AN ARRANGEMENT

CROSS-REFERENCE TO RELATED APPLICATIONS

This patent application claims priority benefit under 35 U.S.C. §119(e) of copending, U.S. Provisional Patent Application, Ser. No. 61/034,536, filed Mar. 7, 2008, the disclosure of which is incorporated by reference herein in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

The present invention relates generally to food product arrangements and, more particularly, relates to a method and apparatus for assembling food product display arrangements such as fresh fruit displays.

2. Related Art

Generally speaking, it is well known to purchase and gift food product arrangements such as fruit baskets for special occasions. As a vendor, it is desirable to assemble such product arrangements in an efficient and cost effective manner, to provide quality food products and other components within the arrangement, and to ensure that the finished arrangement is visually interesting and aesthetically pleasing. As can be appreciated, design and preparation of such an arrangement is a skilled task. Not only is skill involved in selecting quality products, but also in placing the products within the arrangement. When building a brand identity, for example, once a successful design of an arrangement is produced, it is desirable to ensure that subsequent arrangements are prepared in a consistent manner to achieve substantially the same overall impression. Accordingly, training and experience is required.

As noted above, other components are commonly used in a food product display, such as, for example, paper and/or plastic wrap, stands and support structure to allow assembly of the food product arrangement in accordance with a particular design form. It is desirable for one or more support structures to be included in an arrangement so that one or more food products may be displayed at certain angles to highlight or feature the product. In food product displays, it is preferred that all such wrap, stands and structure are food safe, that is, edible or at least items that do not release harmful agents. To avoid even an appearance of a harmful component, food product arrangements often use other food products that are known to be safe to consume such as, for example, lettuce, within the food product displays to support and/or feature other food products. For example, a head of lettuce or portion thereof, may be used to at least partially fill a container that holds the food products in the arrangement. Some perceived difficulties in using some types of food products as supports in the display is the need to keep a sufficient quantity of that food product on hand in a fresh and aesthetically pleasing condition. For some food products such as lettuce, for example, price and availability varies through out the calendar year.

The inventor has found that the conventional use of lettuce as a support is inefficient and at times, cost prohibitive. Unlike other product displays, such as floral displays which use a foam material typically referred to as florist foam, a food safe alternative does not exist. Having recognized this need, the inventor has developed a food safe foam material for use as a support that is an improvement over prior art supports as well as a method for using the material in the assemble of decorative food product displays.

SUMMARY OF THE INVENTION

The present invention resides in one aspect in a first support for a food product display arrangement. The first support includes a cylindrical structure having a diameter, an exterior surface and a height. The cylindrical structure is a food safe, foam material having a density suitable for supporting at least one of food products and display elements thereon. In one embodiment, the cylindrical structure is selectively adjustable about its diameter and height to accommodate a container used in the display arrangement. In one embodiment, the cylindrical structure includes at least one of a slit running perpendicularly to and at an angular offset to the height of the structure for adjusting the height. In another embodiment, the cylindrical structure includes a slit running parallel to a vertical axis of the structure for adjusting the diameter of the structure.

In another aspect of the invention, a plurality of second supports are disposed in the first support at positions and angles to create a visually interesting and aesthetically pleasing food product display arrangement. A plurality of food items and display elements are coupled to the second supports.

In yet another aspect of the invention, a food product display arrangement includes a container having an interior volume, a first support disposed in the interior volume, and a plurality of second supports disposed in the first support at positions and angles to create a visually interesting and aesthetically pleasing food product display arrangement. In one embodiment, the first support includes a cylindrical structure having a diameter and a height. The cylindrical structure is selectively adjustable about at least one of the diameter and the height for a secure fit within the interior volume of the container. In one embodiment, a plurality of food items and/or display elements are coupled to the second supports.

In still another aspect of the invention, a method for assembling a decorative food product display arrangement is presented. The method includes steps of selecting one of a plurality of containers, each container having an interior volume; selecting a first support and adjusting at least one of a diameter and a height of the first support to securely fit within the interior volume of the selected container; inserting a plurality of second supports into the first support at one of a position and an angle to create a visually interesting and aesthetically pleasing food product display arrangement; and coupling a plurality of food items to the second support.

In one embodiment, the plurality of food items in the decorative food product display arrangement includes fruit assembled to look like a floral arrangement. In one embodiment, the step of adjusting the first support includes adjusting a height of the first support by separating the first support at a slit running perpendicularly to a vertical axis of the support. In yet another embodiment, the step of adjusting the first support includes adjusting a diameter of the first support by separating the first support at a slit running parallel to a vertical axis of the support.

BRIEF DESCRIPTION OF THE DRAWINGS

The features and advantages of the present invention will be better understood when the Detailed Description of the Preferred Embodiments given below is considered in conjunction with the figures provided.

In these figures like structures are assigned like reference numerals, but may not be referenced in the description of all figures.

DETAILED DESCRIPTION OF THE PREFERRED EMBODIMENTS

Figure 1:
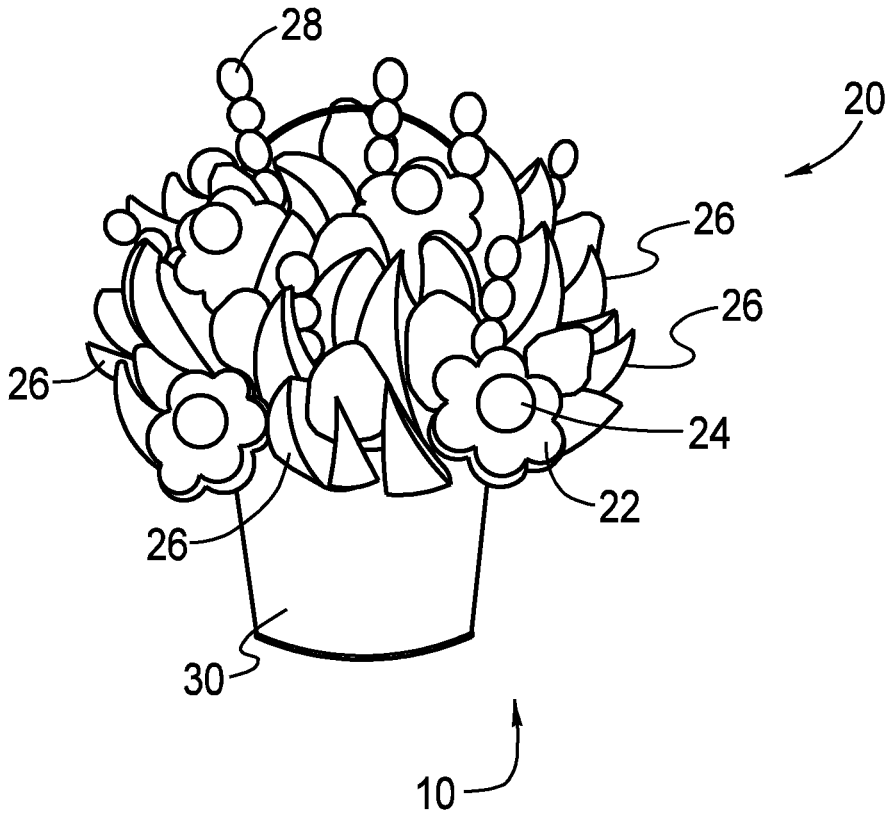
FIG. 1 is a front elevational view of a decorative food product display arrangement in accordance with one embodiment of the present invention.
Figure 2:
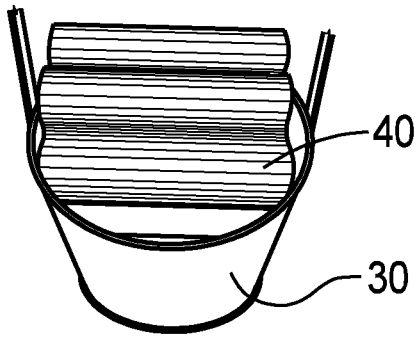
FIG. 2 is a perspective view of one embodiment of a support member disposed in a container of the food product display arrangement of FIG. 1.

As noted above, the preparation of decorative food display arrangements is a skilled task. This is particularly true when fruit is assembled in an arrangement designed to look like a floral arrangement. For example, FIG. 1 illustrates fruit such as melon, cantaloupe, pineapple, strawberries, grapes and the like, shown generally at 20, assembled within a container 30 to provide a decorative arrangement 10 that resembles a floral arrangement. In one embodiment, a cut piece of pineapple 22 and a melon ball 24 are assembled to resemble a daisy, while melon slices 26 are cut and arranged to resemble leaves of a flower, and grapes 28 are collected and assembled to resemble a string of berries. As is shown in FIG. 1, the decorative arrangement 10 includes pieces of fruit 20 positioned within the container 30 at differing heights and angles designed to create the desired overall floral effect. In one embodiment, a main support structure (not shown) is disposed in the container 30. The main support structure receives a plurality of support structures, such as skewers, tooth picks or like food safe utensil, that individually secure a piece or pieces of fruit 20 within the arrangement 10. FIG. 2 illustrates one embodiment of the main support structure, referred to herein as arrangement foam 40, that is disposed in the container 30 to support one or more food products placed in the container 30, for example, the fruit 20. As described below, the arrangement foam 40 allows the fruit 20 to be inserted, positioned and securely held within the container 30 at any number of positions and angles to achieve the desired effect.

Figure 3A:
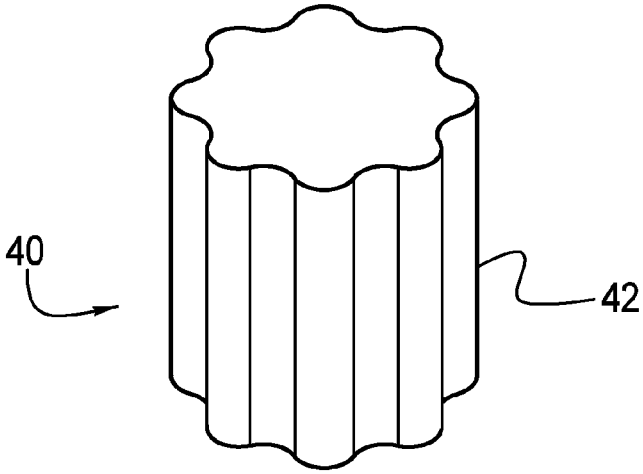
FIGS. 3A-3C illustrate the support member of FIG. 2 in accordance with one embodiment of the present invention.
Figure 3C:
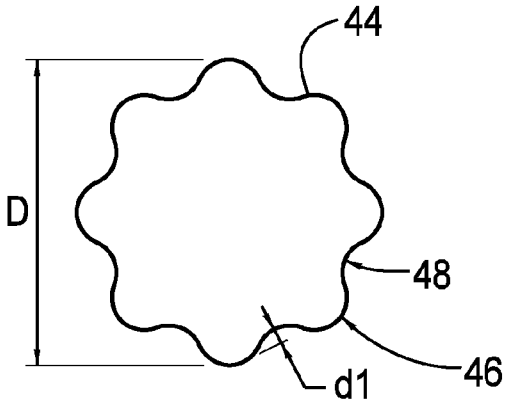
Figure 3B:
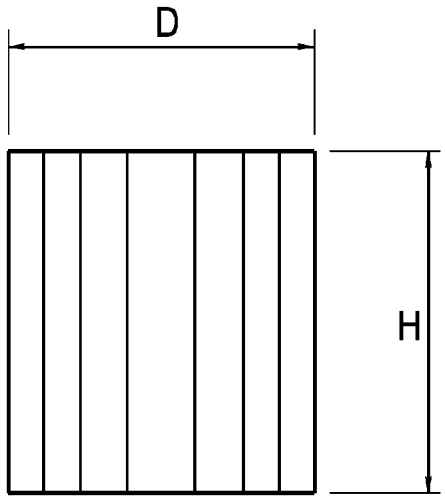

FIGS. 3A-3C illustrate one embodiment of the arrangement foam 40. As shown in FIGS. 3A-3C, the arrangement foam 40 is comprised of a cylindrical structure 42 having a diameter D and a height H suitable for supporting food products assembled within a particular display. An exterior surface 44 of the diameter D of the arrangement foam 40 need not be uniform. For example, the cylindrical structure 42 has a scalloped appearance such that the exterior surface 44 of the diameter D includes peaks 46 and valleys 48 when viewed from above. In one embodiment, illustrated in FIG. 3C, a distance d1 between the peaks 46 and the valleys 48 is, for example, a distance of about one quarter of an inch (0.25 in., 0.60 centimeters (cm)). In another embodiment, the distance d1 is, for example, a distance of about three-eighths of an inch (0.375 in., 1.0 cm). In one embodiment, the diameter D is comprised of a diameter of, for example, about three and one half inches (3.5 in., 8.9 cm) and the height H is comprised of a height of, for example, about five inches (5 in., 12.7 cm). In another embodiment, the diameter D is a diameter of, for example, about three and one half inches (3.5 in., 8.9 cm) and the height H is a height of, for example, about fifteen and one half inches (15.5 in., 39.4 cm). In yet another embodiment, the diameter D is a diameter of, for example, about five inches (5 in., 12.7 cm), the height H is a height of about five and one quarter inches (5.25 in., 13.3 cm). In still another embodiment, the cylindrical structure 42 has a diameter of about four and one half inches (4.5 in., 11.4 cm). It should be appreciated that it is within the scope of the present invention to vary the diameter D and height H to accommodate various sized containers 30. Similarly, it is within the scope of the present invention to vary the distance d1 as well as to remove the distance d1 such that the exterior surface 44 of the diameter D forms a substantially uniform exterior surface.

Figure 4A:
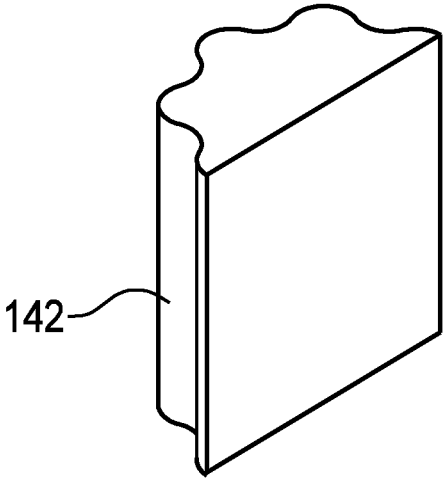
FIGS. 4A-4C illustrate the support member of FIG. 2 in accordance with another embodiment of the present invention.
Figure 4C:
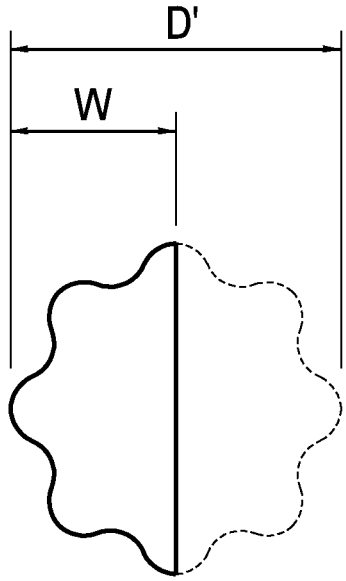
Figure 4B:
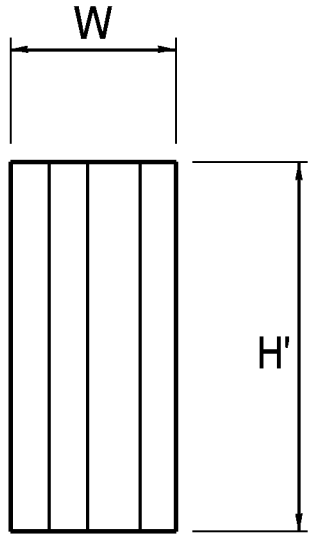

In one embodiment, the above described cylindrical structure 42 of the arrangement foam 40 is partitioned about its diameter D such that only a portion of the diameter D, for example, about two-thirds (⅔), one half (½), one third (⅓), one quarter (¼), or the like, of the diameter D is disposed in the container 30. It should be appreciated that any fractional amount of the diameter may be utilized as an interior volume of the container 30 and/or support needs of the decorative arrangement 10 dictate. For example, in FIGS. 4A-4C, the arrangement foam 40 is comprised of a partitioned cylindrical structure 142 having a height H' and a diameter D' partitioned at a width W. In one embodiment, illustrated in FIG. 4C, the width W is about one half of the diameter D'. In one embodiment, the diameter D' is a diameter of, for example, about five inches (5 in., 12.7 cm), the height H' is a height of about five and one quarter inches (5.25 in., 13.3 cm) and the width W is a width of about two and one half inches (2.5 in., 6.4 cm). In another embodiment, the diameter D' of the cylindrical structure 142 is a diameter of about three and one half inches (3.5 in., 8.9 cm), the width W is a width of about one and three-quarter inches (1.75 in., 4.4 cm) and the height H' is a height of about five inches (5 in., 12.7 cm).

Figure 5A:
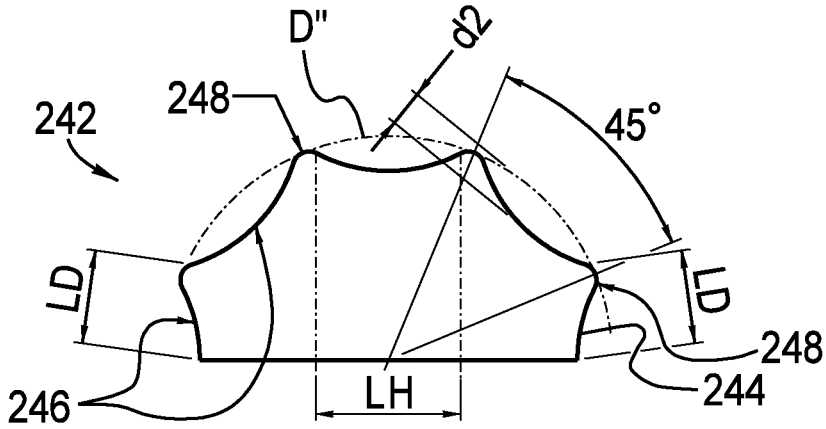
FIGS. 5A and 5B illustrate the support member of FIG. 2 in accordance with yet another embodiment of the present invention.
Figure 5B:
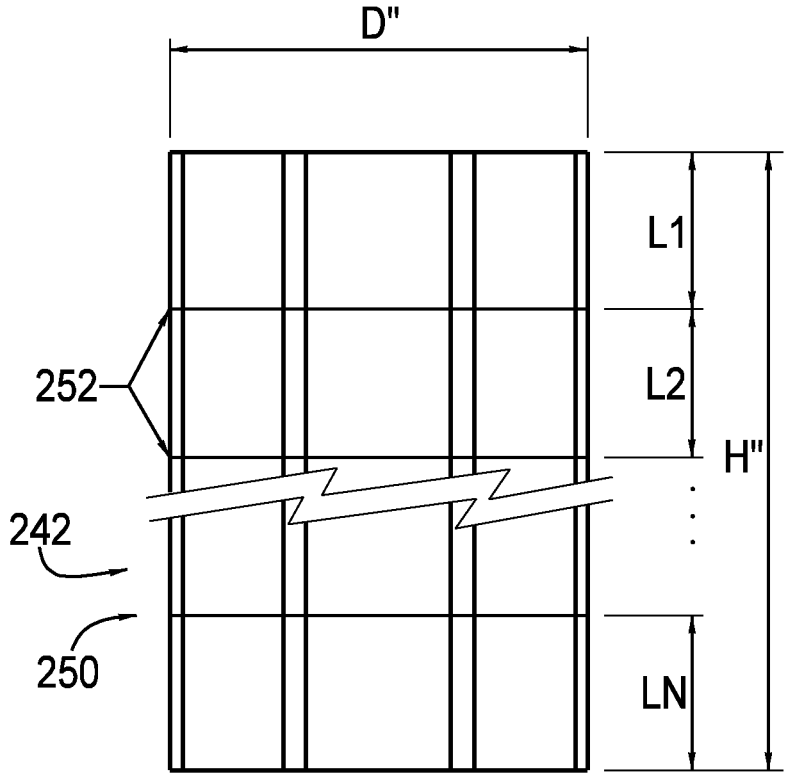

In one embodiment, shown in FIGS. 5A and 5B, the arrangement foam is comprised of a partitioned cylindrical structure 242 having a diameter D" with a non-uniform exterior surface, for example, an exterior surface 244 formed of a plurality of curved or arced lines 246 connected by a plurality of radii 248. In one embodiment, the diameter D" is, for example, a diameter of about four and one half inches (4.50 in., 11.4 cm), the curved lines 246 are disposed about the diameter D" at, for example, about forty-five degree (45°)

angles in increments of length $L_D$ of, for example, about one and one quarter inches (1.25 in., 3.20 cm), and are connected by the plurality of radii 248 of, for example, about one quarter inch (0.25 in., 0.60 cm). In one embodiment, the curved lines 246 span a horizontal length $L_H$ of, for example, about one and one half inches (1.50 in., 3.80 cm) and cooperate with the radii 248 to form peaks and valleys in the exterior surface 244 of the diameter D". In one embodiment, a distance d2 between the peaks and the valleys is, for example, a distance of about one quarter of an inch (0.25 in., 0.60 cm).

In one embodiment, the partitioned cylindrical structure 242 includes at least one slit 250 running perpendicular to, or at an angular offset to, a height H" of the structure 242. The slit 250 permits separation of the cylindrical structure (e.g., splitting by force or cutting) into two or more portions of the arrangement foam 40 to, for example, adjust a height of the arrangement foam 40. In one embodiment, the slit 250 extends from the exterior surface 244 into only a portion of the cylindrical structure 242 so as not to completely sever the body of the arrangement foam 40 at the slit 250 thus allowing the structure to remain a unitary body. As such, a force is needed to break the cylindrical structure 242 at the slit 250. Alternatively, rather than separating the cylindrical structure 242 and adjusting the height, the slit 250 allows the cylindrical structure to be spread apart and bent out of a common vertical or horizontal plane such that, for example, the arrangement foam 40 fits more securely within the container 30 and/or lies in the container 30 in a manner that permits arrangement of the fruit 20 at more interesting positions and/or angles to achieve a desired effect. In one embodiment, shown in FIG. 5B, the slit 250 includes a plurality of slits 252 disposed along the height H' at lengths L1-Ln such that the cylindrical structure 242 may be selectively separated into portions as needs of various sized containers or arrangements dictate. In one embodiment, the lengths L1-Ln are the same such as, for example, a length of about one and three-quarter inches (1.75 in., 4.4 cm). In one embodiment, the length L1-Ln between the plurality of slits 252 varied such that the cylindrical structure 242 or a desired portion of cylindrical structure 242 may be selected based on its length and fit within the container for a particular arrangement.

Figure 6A:
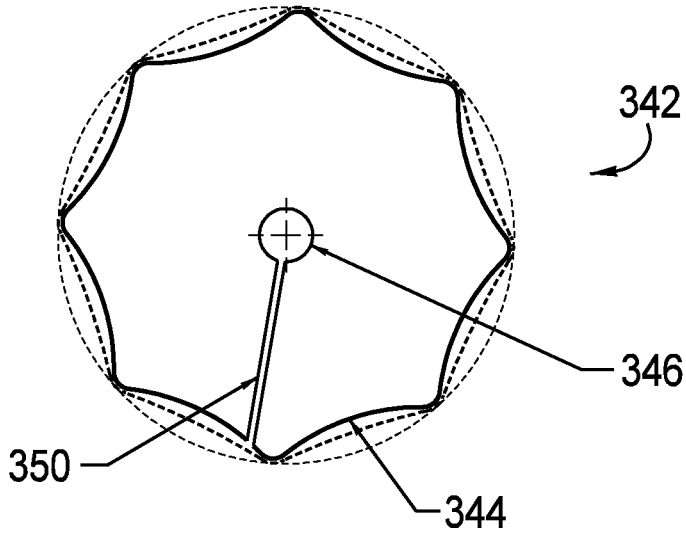
FIGS. 6A and 6B illustrate the support member of FIG. 2 in accordance with still another embodiment of the present invention.
Figure 6B:
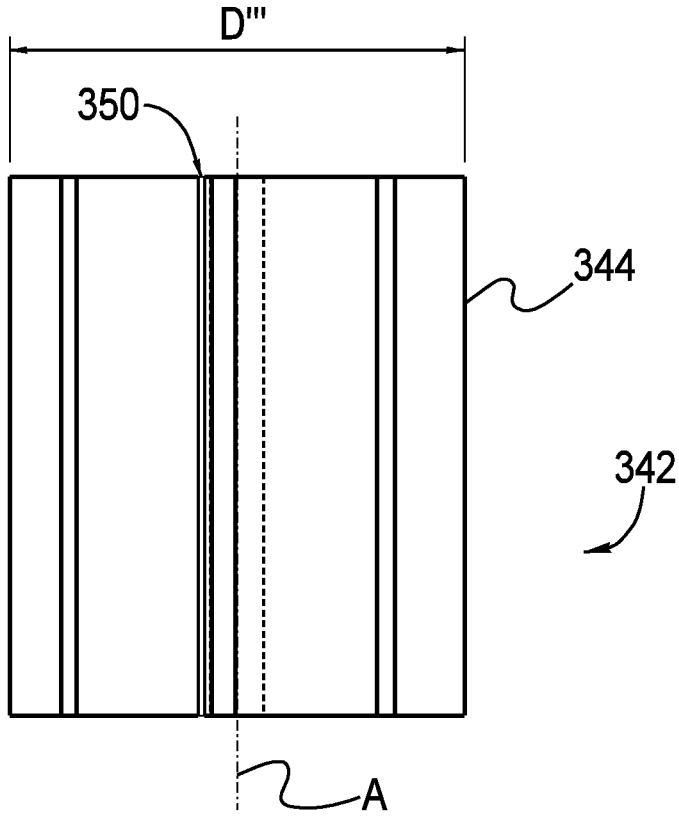

In one embodiment, illustrated in FIGS. 6A and 6B, the arrangement foam 40 is comprised of a partitioned cylindrical structure 342 having an exterior surface 344, a diameter D'" and a bore 346 extending a total height of the structure 342 and centered about a vertical axis A of the structure 342. In one embodiment, the cylindrical structure 342 includes a slit 350 that is parallel to the vertical axis A and traverses the total height of the structure 342. The slit 350 extends from the exterior surface 344 to the bore 346. In one embodiment, the slit 350 permits separation of the cylindrical structure 342 into two or more portions or wedges of the diameter D'" such that the diameter of the arrangement foam 342 may be selectively adjusted (e.g., split by force or cut) to accommodate various sized and shaped containers. As with the aforementioned slits 250, a force is needed to break the cylindrical structure 342 at the slit 350. Similarly, rather than separating the cylindrical structure 342 and adjusting its diameter, the slit 350 allows the cylindrical structure to be spread apart about the vertical axis A such that, for example, the arrangement foam 40 fits more securely within the container 30 and/or lies in the container 30 in a manner that permits arrangement of the fruit 20 at more interesting positions and/or angles to achieve a desired effect. In one embodiment, the parallel slit 350 also allows the cylindrical structure 342 to release gases that may otherwise be trapped within the arrangement foam 40. The release of these gases makes the arrangement foam 40 softer and more pliable.

As shown in FIGS. 4A-4C, 5A-5C and 6A-6B, it is within the scope of the present invention for the arrangement foam 40 to include various slits along its height and/or diameter such that the arrangement foam 40 is selectively adjustable about its height and/or diameter. It should be appreciated that any fractional amount of the height and/or diameter of the arrangement foam 40 may be utilized as an interior volume of the container and/or support needs of the decorative arrangement 10 dictate. It is also within the scope of the present invention for the arrangement foam to include various exterior surface profiles such as the aforementioned scalloped profile illustrated in FIG. 3A and the profile of curved lines and connecting radii of FIG. 5A. In other embodiments, the exterior surface of the cylindrical structure is substantially smooth and uniformly circular. As such, it should be appreciated that the shape and appearance of the cylindrical structure may include any possible shape or design.

In one embodiment, the arrangement foam 40 is comprised of a foam material effective for supporting a display arrangement. For example, a first end of one or more supports such as skewers, tooth picks, and the like, is inserted into the arrangement foam 40 such that the support is held in place (e.g., supported) at a desired position and/or angle by the arrangement foam 40, while an opposite end of the support pierces the fruit 20, food item, placard or card, or any other display element to be exhibited within the arrangement. As can be appreciated, the density of the arrangement foam 40 is sufficient to support the weight of the object displayed on the support. In one embodiment, the foam has a chemical composition of, for example, about ninety-eight percent (98%) by weight of low density polyethylene (LDPE) based on the total weight of the foam, about one percent (1%) by weight of distilled monoglyceride based on the total weight of the foam, and about one percent (1%) by weight of talc based on the total weight of the foam. As should be appreciated, the percentages of these components may vary, so long as the arrangement foam is sufficient to support a display and the arrangement foam is non-toxic and food safe. In one embodiment, the arrangement foam material is biodegradable and/or recyclable. In addition, the arrangement foam may be manufactured in a variety of colors for aesthetic purposes such as, for example, being a green color to blend in as greenery within the arrangement 10.

As can be appreciated, the arrangement foam 40 of the present invention offers several advantages over prior art apparatus for use in food displays. For example, the use of the non-toxic, food safe arrangement foam 40 as a support element replaces perishable support elements such as cabbage or lettuce, that are generally in use in food display arrangements. At least one perceived advantage includes a safety and health benefit as the use of a safe, non-toxic, food safe arrangement foam material reduces, if not substantially eliminates, concerns related to growth of *E coli*, bacteria, or like concerns, associated with the use of perishable support elements. Additionally, the disclosed arrangement foam 40 has a longer shelf life than the perishable items previously used, for example, months or years as compared to days or weeks with perishable food items. The longer shelf life also minimizes concerns with respect to the consistency (e.g., freshness) and availability of the support element. For example, because the arrangement foam is made from a man-made material, a reliable supply (e.g., consistent in terms of availability and cost) can be developed, unlike perishable food elements such as cabbage or lettuce, which may experience periodic shortages due to seasonal growing patterns and a reliance on a bountiful harvest for predictable cost. Moreover, since the arrangement foam 40 is non-perishable, a plurality of containers 30 and the arrangement foam 40 support elements in various shapes and sizes can be pre-assembled in advance during periods of light volume and available for use by personnel as base elements for display arrangements 10 during periods of high volume. Such a pre-assembly of base elements of decorative food product arrangements is seen as a tool for increasing efficiency and productivity of a business entity assembling such arrangements.

In one aspect of the present invention, the base elements are pre-assembled as follows. As noted above, in one embodiment, the base elements include containers 30 and arrangement foam 40 of various shapes and sizes. For example, in one embodiment, the arrangement foam 40 includes a first arrangement foam 442 similar to the arrangement foam 40 illustrated in FIG. 3A-3C having a complete diameter with a scalloped exterior surface, and a second arrangement foam 542 similar to the arrangement foam 142 illustrated in FIG. 5A-5C having a partitioned diameter and a scalloped exterior surface. The first and the second arrangement foam 442 and 542, respectively, are selectively used depending on characteristics, for example, the shape and size, of the container 30 used for the decorative arrangement. In one embodiment, containers include containers having round or circular cross-sections, square cross-sections, oval cross-section, and the like, of various diameters and dimensions.

Figure 7A:
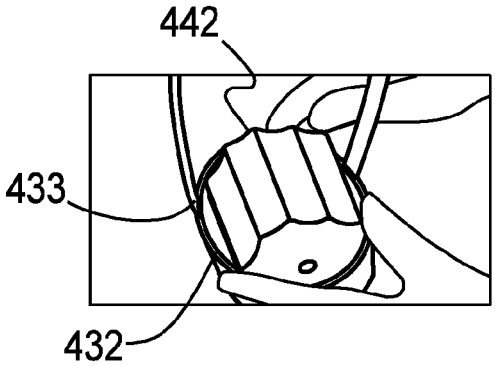
FIGS. 7A-7E illustrate steps for assembling decorative food product display arrangements using the support member of the present invention.
Figure 7B:
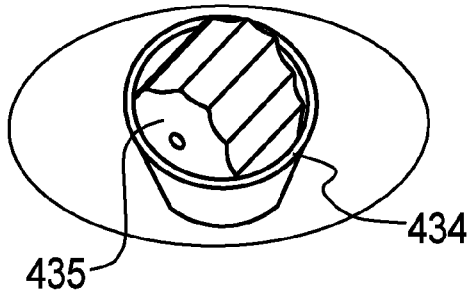
Figure 7C:
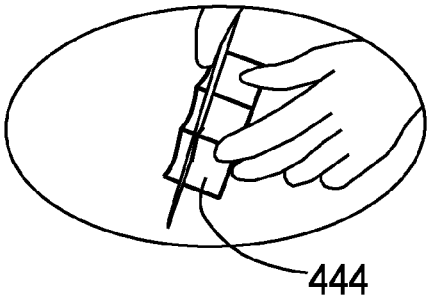
Figure 7D:
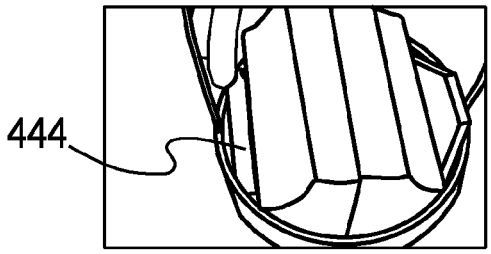

As shown in FIGS. 7A and 7B, the first arrangement foam 442 is typically used when pre-assembling an arrangement having a round container 30 such as containers 432 and 434. As can be appreciated, the height of the arrangement foam 442 is selectively adjusted to fit, when placed in a horizontal plane, an inner diameter 433 and 435 of the containers 432 and 434, respectively. For example, the height of the arrangement foam 442 may be cut to fit securely in the diameters 433 and 435 or, when the arrangement foam 442 includes a plurality of slits such as the slits 252 of FIG. 5B, the arrangement foam 442 may be partitioned at a predetermined height to fit the containers 432 and 434. As shown in FIGS. 7C and 7D, a portion 444 of the arrangement foam 442 such as, for example, a third (⅓), a quarter (¼), a half (½), or the like, of the arrangement foam 442 between adjacent slits 252 may be cut (e.g., with a knife (FIG. 7C)), and positioned about one or more sides of the arrangement foam 442 to fill a volume of the inner diameters 433 and 435 (FIG. 7D). In one embodiment, the portion 444 may be used to support (e.g., by friction fit about the diameter 433 and 435) the arrangement foam 442 in a vertically elevated position within the containers 432 and 434. In this regard, the arrangement foam 442 does not contact a bottom surface of the containers 432 and 434 but rather is suspended within the diameters 433 and 435 by the above-described friction engagement between the portion 444, the arrangement foam 442 and the inner diameters 433 and 435. Alternatively, rather than the frictional engagement, the portion 444 may be placed on the bottom surface of the containers 432 and 434 and the arrangement foam 442 stacked on the portion 444 to achieve the vertically elevated position in the container.

Figure 7E:
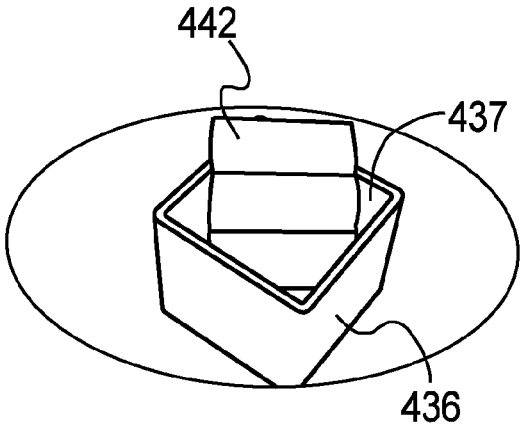

As shown in FIG. 7E, the first arrangement foam 442 may also be used when pre-assembling an arrangement having a square container 30 such as, for example, container 436. In one embodiment, the arrangement foam 442 is placed diagonally within an interior volume 437 of the container 436. As described above, the height of the arrangement foam 442 is selectively adjusted to fit the interior volume 437, for example, by cutting the foam or separating the foam at a slit. One or more portions 444 (not shown) may also be added to the container 436 to substantially fill the interior volume 437, for example, gaps at corners of the square container 436.

Figure 8A:
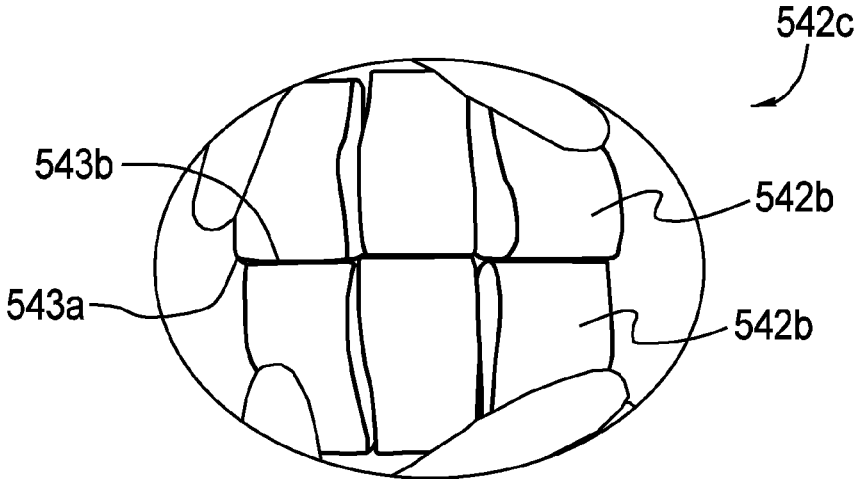
FIGS. 8A-8C illustrate further steps for assembling decorative food product display arrangements using the support member of the present invention.
Figure 8B:
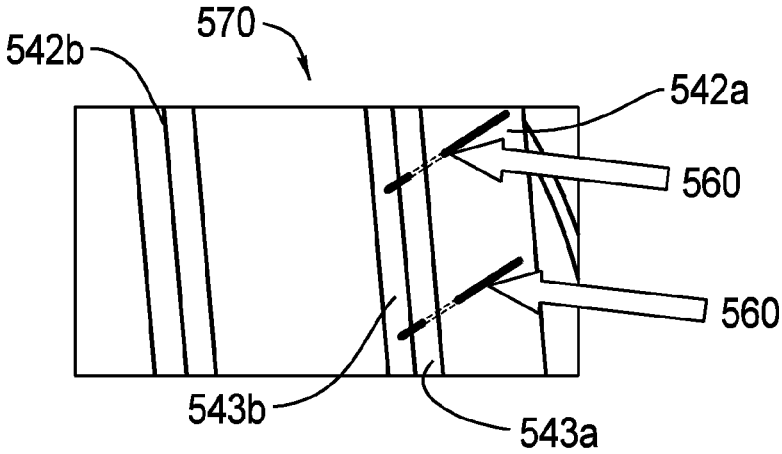
Figure 8C:
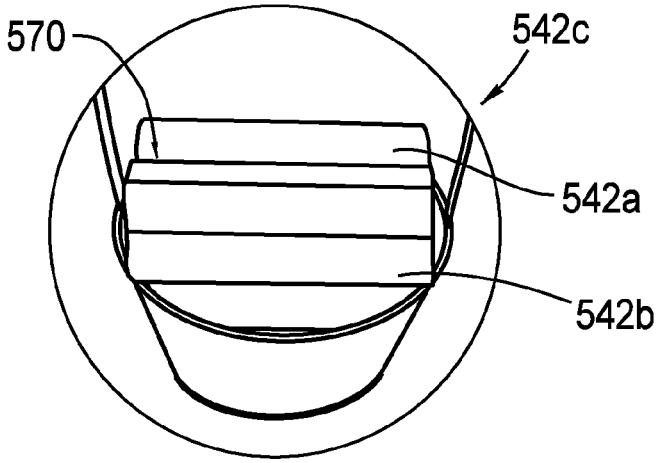

It should be appreciated that two pieces of the second arrangement foam 542 may be used in place of the first arrangement foam 442 in the aforementioned round and square containers 432, 434 and 436. For example, as shown in FIGS. 8A-8C, two pieces of the second arrangement foam 542*a* and 542*b*, respectively, may be placed such that their substantially flat sides 543*a* and 543*b*, respectively, abut to form a relatively circular, joined configuration shown generally at 542*c* (FIG. 8A). In one embodiment, supports 560 such as skewers, tooth picks and the like, secure or fasten the two pieces of the second arrangement foam 542*a* and 542*b* together in the joined configuration 542*c* (FIG. 8B). The joined configuration 542*c* is then typically disposed within the inner diameter of one of the circular containers (FIG. 8C). In one embodiment, when the joined configuration 542*c* is disposed in the container, a seam 570 defined by the abutting sides 543*a* and 543*b* of the joined configuration 542*c* faces the bottom surface of the container. Moreover, if the container includes handles, as shown in FIG. 8C, ends of the seam 560 are positioned to typically face the handles.

Figure 9A:
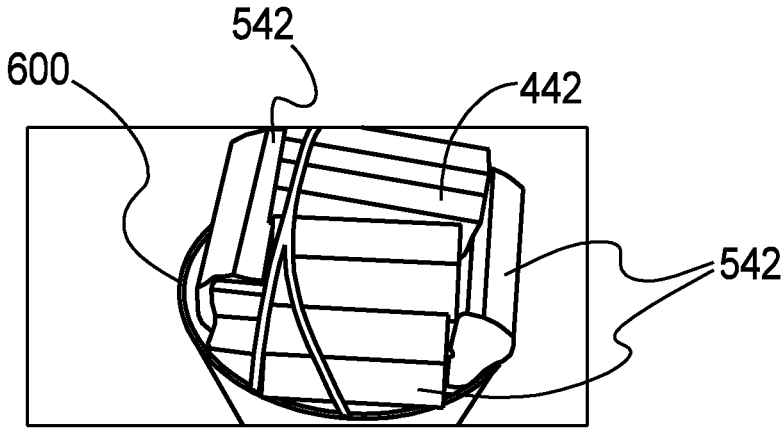
FIGS. 9A and 9B illustrate still further steps for assembling decorative food product display arrangements using the support member of the present invention.
Figure 9B:
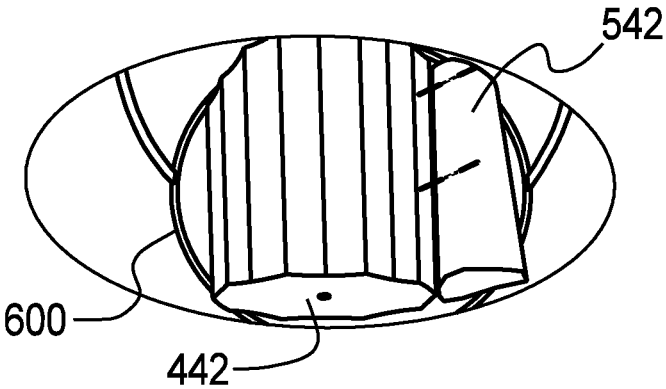

In instances where a decorative food product arrangement is needed that includes a relatively large container, two or more pieces of the first arrangement foam 442 and/or the second arrangement foam 542 may be used to fill the interior volume of the container. For example, as shown in FIGS. 9A and 9B, pieces of the first arrangement foam 442, for example, two pieces, are used to fill a central portion of an interior volume of a relatively large container 600 and pieces of the second arrangement foam 542, for example, four pieces, are used to fill a perimeter of the container. As needed, one of more cut portions of arrangement foam 40 are used to fill any remaining gaps in the interior volume of the container 600. As described above, two or more pieces of the arrangement foam 40, 442 and 542 may be coupled together with supports such as, skewers, tooth picks and the like, to secure the foam within the interior volume of the container. Moreover, cut portions of the arrangement foam 40 may be placed under other pieces of arrangement foam such as, for example, the first arrangement foam 442 disposed in the central portion of the interior volume so that the central portion is vertically higher the pieces of the second arrangement foam 542 disposed at the perimeter of the container. For example, the inventor has found that differing the height of one or more pieces of arrangement foam enables assembly of food product arrangements that are visually interesting and aesthetically pleasing.

As can be appreciated, once interior portions of a selected container are filled with arrangement foam 40, a plurality of supports (e.g., skewers, tooth picks, and the like) may be fastened within the arrangement foam. Food products such as, for example, fruit, is then secured to the plurality of supports to achieve a decorative arrangement such as the food product arrangement 10 of FIG. 1.

One or more embodiments of the present invention have been described. Nevertheless, it will be understood that various modifications may be made without departing from the spirit and scope of the invention. Accordingly, other embodiments are within the scope of the following claims.

Although this invention has been shown and described with respect to the detailed embodiments thereof, it will be understood by those of skill in the art that various changes may be made and equivalents may be substituted for elements and steps thereof without departing from the scope of the invention. In addition, modifications may be made to adapt a particular situation to the teachings of the invention without departing from the essential scope thereof. Therefore, it is intended that the invention not be limited to the particular embodiments disclosed in the above detailed description, but that the invention will include all embodiments falling within the scope of the above description.

What is claimed is:

1. A food product display arrangement, comprising:

a container having an interior volume;

a first foam support disposed in the interior volume, the first foam support comprised of a cylindrical structure having an exterior surface, a diameter and a height, the cylindrical structure including at least one slit extending from the exterior of the surface into a portion of the cylindrical structure so as not to completely sever the cylindrical structure, the slit being selectively adjustable enabling the first foam support to abut the interior of said container to securely fit the first foam support within the interior volume;

a plurality of second supports having a first end and a second end, each of the first ends disposed in the support at a position and an angle to create a visually interesting and aesthetically pleasing food product display arrangement, said second ends being skewered into fruit enabling said fruit to be supported by said first foam support at a height and desired configuration configured into a floral display arrangement; and said first foam support comprised of low density polyethylene, distilled monoglyceride and talc having sufficient structural strength and stability for receiving said first ends of said second supports embedded within the first foam support for supporting the weight of the fruit carried by the second ends of said supports in a position and angle maintained when said first ends of said second support are inserted into said first foam support thereby maintaining the aesthetically pleasing fruit display floral arrangement; and wherein the low density polyethylene is present in an amount of about ninety-eight percent (98%) by weight, the distilled monoglyceride is present in an amount of about one percent (1%) by weight and the talc is present in an amount of about one percent (1%) by weight based on the total weight of the cylindrical structure.

2. A food product display arrangement having fruit product positioned on skewers, comprising:

a container having an interior surface defining an interior volume;

a foam support disposed in the interior volume, the first foam support comprised of a cylindrical structure having an exterior surface, a diameter and a height, wherein the cylindrical structure is comprised of a food safe foam material having a density suitable for supporting at least one of the fruit product positioned on a skewer;

said exterior having a non-uniform shape including a plurality of arches having valleys and peaks forming a concave profile with outwardly extending peaks, said outwardly extending peaks for engaging said container enabling said valleys to define air pockets in combination with said interior surface;

wherein said foam support may flex outward towards said container interior surface into said air space when carrying fruit product positioned on skewers;

said foam support comprised of low density polyethylene, distilled monoglyceride and talc having sufficient structural strength and stability for receiving said first ends of said skewers embedded within the first foam support for supporting the weight of the fruit carried by the second ends of said skewers in a position and angle maintained when said first ends of said skewers support are inserted into said foam support thereby maintaining the aesthetically pleasing fruit display floral arrangement; and wherein the low density polyethylene is present in an amount of about ninety-eight percent (98%) by weight, the distilled monoglyceride is present in an amount of about one percent (1%) by weight and the talc is present in an amount of about one percent (1%) by weight based on the total weight of the cylindrical structure.

* * * * *